US005937813A

United States Patent [19]

Shifflette

[11] Patent Number: 5,937,813

[45] Date of Patent: Aug. 17, 1999

[54] RESETTABLE PRESSURE RELIEVING SPARK PLUG

[76] Inventor: J. Michael Shifflette, 5900 SW. 196th La., Fort Lauderdale, Fla. 33332

[21] Appl. No.: 09/069,538

[22] Filed: Apr. 29, 1998

[51] Int. Cl.[6] ..... H01T 13/08

[52] U.S. Cl. ..... 123/169 V; 313/120

[58] Field of Search ..... 123/151, 152, 123/169 V, 630; 313/120, 135

[56] References Cited

U.S. PATENT DOCUMENTS

| | | | |
|---|---|---|---|
| 3,079,453 | 2/1963 | Clark . | |
| 3,737,708 | 6/1973 | Vaillancour et al. | 313/120 |
| 4,079,721 | 3/1978 | Brown | 123/169 V |
| 4,326,145 | 4/1982 | Foster et al. . | |
| 4,699,096 | 10/1987 | Phillips . | |
| 4,823,746 | 4/1989 | Kaplan | 123/169 V |
| 5,245,959 | 9/1993 | Ringenbach . | |
| 5,632,659 | 5/1997 | Martin et al. . | |
| 5,706,847 | 1/1998 | Strait et al. | 313/135 |
| 5,799,634 | 9/1998 | Shifflette | 313/120 |

*Primary Examiner*—Erick R. Solis
*Attorney, Agent, or Firm*—Malin, Haley, DiMaggio & Crosby, P.A.

[57] ABSTRACT

A pressure relieving spark plug for use with an internal combustion engine. The pressure relieving spark plug functions as a conventional spark plug under normal operating conditions; however, upon the development of abnormal conditions, such as excessive combustion chamber pressures or excessive engine temperatures, the spark plug is designed relieve cylinder pressure by one or more venting stages such that damage to the engine is averted. Once actuated to one or more venting stages, the spark plug is resettable to a configuration wherein the spark plug is again capable of functioning as a conventional spark plug.

19 Claims, 11 Drawing Sheets

RESETTABLE PRESSURE RELIEVING SPARK PLUG

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to spark plugs for use with internal combustion engines, and more particularly to a resettable pressure relieving spark plug for venting the combustion chamber of an internal combustion engine in response to abnormal engine operating conditions.

2. Description of Related Art

The many uses of internal combustion engines are well known. Internal combustion engines extract work from the combustion of a mixture of fuel and oxygen. Combustion typically occurs within the confines of a cylinder wherein useful work is extracted from the expansion of the products of combustion pushing against a movable piston. In other internal combustion engines, such as a rotary or Wankel engine, work is extracted from the expansion of the products of combustion by a rotating rotor. Accordingly, in a conventional piston engine work is extracted by compressing a mixture of fuel and air and igniting the mixture, typically by use of a spark plug, thereby increasing the pressure and temperature of the products of combustion within the confines of the cylinder, and extracting work from the pressure differential between the cylinder and atmosphere. Internal combustion engines are widely used in all modes of transportation.

Internal combustion engines extract work from the pressure generated by the combustion of a volatile fuel/air mixture within a combustion chamber. In a piston engine, a combustion chamber is defined by a pressure vessel formed by the cylinder and a piston slidably disposed therein. Peak cylinder pressures typically fall within the range of 7 MPa to 8 MPa (roughly 1000 psi–1200 psi), and engine components may fail if pressures exceed 15 MPa (2200 psi). Spark-ignition engines typically have compression ratios between 6:1 and 12:1, use carburetors, or fuel-injection systems, and operate on the Otto cycle. Compression-ignition engines use liquid fuels of low volatility, such as fuel oil, have compression ratios between 11.5:1 and 22:1, and operate on the diesel cycle. The four-stroke-cycle engine requires four piston strokes or two crankshaft revolutions per cycle. The two-stroke-cycle engine requires two piston strokes, or only one crankshaft revolution for each cycle.

In the United States, the automobile is the dominant mode of transportation. Each year approximately 2 trillion passenger miles are traveled by car. Accordingly, internal combustion engines are an integral part of every day life. Therefore, maintaining internal combustion engines in good operating condition is an important part of every day life. Internal combustion engines may be damaged, however, when pressure within the combustion chamber (e.g. cylinder) exceeds the maximum design pressure, thereby resulting in engine damage. Such excessive pressure may be caused by any one of several operational occurrences such as hydrolock or detonation.

Hydrolock, also referred to as hydrostatic lock or hydraulic lock, is the phenomenon of engine damage from excessive cylinder pressure due to the presence of an incompressible liquid, typically water, in the engine cylinder. All four-stroke-cycle spark ignition and compression ignition (Diesel) engines, as well as their two-stroke-cycle counterparts, are all at risk of damage from hydrolock, although differences in tolerance and resistance to hydrolock damage exist between engine types. Water may find its way into the engine cylinder in any number of ways. For example, water may enter through a faulty head gasket, or from a leak in the cooling system in the case of water cooled engines. The most common water entry pathway, however, is through the air induction system. The air induction system consists of the airbox, filter, airflow sensor or carburetor, and intake manifold.

In four-stroke-cycle internal combustion engines, hydrolock causes damage when water passes through the engine's air induction system and enters the combustion chamber or cylinder during the intake stroke of the cycle. During the next compression portion of the cycle, the presence of water effectively reduces the volume of the cylinder chamber thereby causing a substantial increase in cylinder pressure well above the design operating pressure due to the incompressibility of water.

Single cylinder, two-stroke-cycle internal combustion engines are less prone to damage from hydrolock since the fuel-air mixture first enters the crankcase prior to entering the combustion chamber. The compression ratio of the crankcase chamber is far lower than the compression ratio in the cylinder. This permits a comparatively large volume of water to enter a two-cycle engine without causing immediate damage and most likely preventing the delivered fuel charge from firing thus stopping the engine before damage could occur. Multi-cylinder, two-stroke-cycle internal combustion engines, however, are prone to hydrolock damage since water which enters the crankcase of one cylinder can be pumped into the non-firing cylinder, since the remaining cylinders continue to operate, thereby causing hydrolock. Accordingly, hydrolock is a significant problem with multi-cylinder, two stroke engines, particularly outboard engines used in marine propulsion.

Automotive engineers have attempted to prevent hydrolock damage by designing air induction systems intended to avoid water ingestion. For example, some manufacturers of light trucks and military vehicles incorporate air intakes which are positioned high on the vehicle. Most vehicles, however, have air induction systems with the air intake located under the hood. For example, vehicles with fuel injected engines are more susceptible to hydrolock because the air intake is typically positioned low, away from engine compartment heat, beneath the hood, such as in the front fender. Accordingly, a vehicle having an air intake positioned below the hood is in danger of ingesting standing water. Even water of a lesser depth may be splashed up into the air intake by movement of the vehicle. Furthermore, off road vehicles, such as modified light trucks, boats, and all terrain vehicles ("ATV's") are presented with an even greater risk of ingesting water due to the presence of water in the off road environment.

Engine damage resulting from the untimely and spontaneous detonation of the fuel/air mixture is a further problem experienced with internal combustion engines. The effects of detonation range from annoying sounds, commonly referred to as engine knock, ping, or preignition, to catastrophic engine failure. Knock sensors and oxygen sensors are two devices frequently employed to abate detonation. Knock sensors detect audible shock waves in the engine block to selectively retard ignition timing, while oxygen sensors monitor exhaust gas oxygen concentrations to detect and correct lean (detonation prone) fuel mixtures.

Detonation, however, remains responsible for a substantial amount of engine damage. A proper combustion event is characterized by a flame front propagating hemispherically away from the ignition source (the spark). As the flame front propagates, it produces a continuing increase in cylinder pressure, effectively driving the piston downward and producing torque on the crankshaft. Detonation, however, is a combustion event wherein the fuel/air mixture spontaneously combusts generating a nearly instantaneous shock (pressure) wave throughout the cylinder in lieu of the propagating front characteristic of a proper combustion event. The nearly instantaneous shock waves characteristic of detonation are detrimental to engine components.

Numerous unsuccessful attempts have been made to provide some way to at least partially alleviate the undesirably high combustion chamber pressures which accompany hydrolock and detonation.

U.S. Pat. No. 4,326,145, issued to Foster et al., discloses a spark plug and a pressure relief adapter for venting a portion of the gases in an engine cylinder during the starting operation.

U.S. Pat. No. 4,699,096, issued to Phillips, discloses a detonation prevention means for an internal combustion engine including a valve which opens in response to a predetermined pressure.

The devices of the background art, however, have only limited venting capabilities and are not suitable for creating a vent passage of sufficient size and venting capacity to effectively expel a sufficient volume of water from a cylinder under hydrolock conditions to prevent damage. Furthermore, the devices of the background art, often require engine modification or the use of complicated and unreliable spark plug assemblies, and, thus, have not gained widespread acceptance. In addition, the background art does not disclose a spark plug for venting cylinder overpressure in response to excessive engine operating temperatures.

Accordingly, there exists a need for an effective pressure relieving spark plug for preventing engine damage resulting from hydrolock and detonation. The references of the background art fail to address the need by providing a resettable pressure relieving spark plug capable of staged venting of a combustion chamber wherein venting capacity is sufficient to prevent hydrolock damage by expelling a sufficient volume of water. In addition, there exists a need for a pressure relieving spark plug which is thermally responsive to excessive engine operating pressure.

My co-pending U.S. Patent application discloses a permanently deforming pressure relieving spark plug which is designed for multiple stage release wherein venting is accomplished by designed structural failure. However, there still exists a need for a resettable (i.e. non-permanently deforming) pressure relieving spark plug that avoids the disadvantages present in the devices of the background art.

BRIEF SUMMARY OF THE INVENTION

This invention is a resettable pressure relieving spark plug for use with an internal combustion engine, which is responsive to excessive pressure within the combustion chamber. A pressure relieving spark plug according to the present invention functions as a conventional spark plug under normal operating conditions. However, upon the development of excessive cylinder pressures, the spark plug is designed relieve cylinder pressure by one or more venting stages such that pressure related engine damage is averted. Staged venting allows for the plug to respond to various degrees of overpressuization. In response to extreme overpressurization, such as hydrolock conditions, the pressure relieving spark plug is designed to eject a substantial portion of the spark plug body thereby creating a substantial combustion chamber vent of sufficient size and venting capacity to effectively expel a sufficient volume of water from a cylinder under hydrolock conditions to prevent damage.

The present invention is equally suited for use with diesel engine glow plugs. Accordingly, all references herein to "spark plug" should be construed to encompass diesel engine glow plugs as well. The term "spark plug" shall, however, be used for consistency.

The spark plug embodiment includes the following major components: a center electrode, an insulating body disposed about the electrode, and upper and lower outer body portions, disposed about the insulating body. The components are assembled into a unitary spark plug body suitable for use with a conventional internal combustion engine wherein the spark plug body effectively seals the combustion chamber (e.g. cylinder) from the ambient under normal operating conditions. The spark plug components are resettably movable from a normal operating configuration, wherein the components function as a conventional spark plug, to at least one venting configuration, wherein a vent passage is formed by the spark plug components to allow for the venting of the combustion chamber to the ambient. In the preferred embodiment, a mechanical detent coupling fastens the upper and lower outer body portions relative to one another such that excessive cylinder pressure results in relative movement between the two body portions thereby opening a vent passage from the combustion chamber to the atmosphere. As should be apparent, the glow plug embodiment will comprise a slightly different structure, yet remain within the scope of the invention.

The mechanical detent coupling preferably comprises at least one recess, and an adjustable pawl, such as a threaded fastener (screw), which is removably received within the recess. Cylinder pressure acts on the insulating body creating an axial force on the upper outer body portion which results in a shear force on the pawl. When the cylinder pressure reaches a predetermined threshold, the axial force causes radial elastic deformation of the upper outer body portion thereby allowing the pawl to be resettably dislodged from the recess and allowing an upward translation of the upper body portion to a position wherein a vent passage is opened. Accordingly, a separation between the upper and lower outer body portions opens a vent passage for relieving excessive cylinder pressure. The detent coupling is resettable by simple mechanical adjustment of the detent coupling mechanism thereby returning the upper and lower outer body portions to the normal operating configuration. In the event that the first stage venting configuration is not sufficient to substantially reduce combustion chamber pressure, the spark plug is capable of at least one further vent stage wherein a substantial portion of the spark plug body is ejected thereby creating a vent passage of sufficient size and venting capacity to effectively expel a sufficient volume of water from a cylinder under hydrolock conditions to prevent damage.

Radial elastic deformation of the upper body portion, and hence venting threshold pressure, may be selectively controlled by a variety of structural features. For example, the pawl may be selected based on tip shape (e.g. flat, radiused, pointed), and/or the contour of the recess may be selected from a variety of shapes (e.g. flat, sloped, radiused), and/or the depth that the pawl tip is received within the recess may be adjusted, each of which effect the force required to achieve radial elastic deformation. Furthermore, the upper outer body portion may define vent slits, the size, shape, and/or number of which will effect the force required to achieve radial elastic deformation. In addition, radial elastic deformation may be selectively and adjustably controlled by adjustably constraining radial elastic deformation of the upper outer body portion, such as by the use of an axially adjustable threaded collar disposed on the upper outer member which provides varying radial rigidity depending on the location of the collar.

In an alternate embodiment, the pressure relieving spark plug of the present invention is further responsive to excessive engine temperatures such as occurs with the aforementioned overpressurization associated with detonation. Specifically, since detonation is often accompanied by engine overheating, and since the combination of overheating and detonation, left unabated, will likely result in engine damage, it is desirable to provide a vent for the combustion chamber thereby diminishing the rate of heat generation. Accordingly, the present invention contemplates the use of components having thermal expansion coefficients greater than the spark plug components, such that excessive engine temperatures cause thermal expansion of these expansion components thereby resulting in the formation of one or more vent passages. In one embodiment, the upper and lower outer body portions are fabricated from metals having dissimilar thermal expansion coefficients such that venting is facilitated by linear and/or volumetric expansion of the outer body portions. In another embodiment, a dissimilar metal insert is incorporated between the outer body portions such that expansion of the insert functions to facilitate venting.

While the present invention is directed primarily to spark plugs used in spark ignition engines, it is contemplated that the present invention is equally adaptable for use with glow plugs in diesel engines, and/or in other configurations wherein a plug may be placed in communication with a pressure vessel.

Accordingly, it is an object of the present invention to provide a pressure relieving spark plug and glow plug for internal combustion engines.

Yet another object of the present invention is to provide a pressure relieving spark plug capable of staged venting of a combustion chamber.

Still another object of the present invention is to provide a pressure relieving spark plug that is resettable to a non-venting configuration after having performed its venting function.

A further object of the present invention is to provide a resettable pressure relieving spark plug that is capable of venting in response to engine overheating.

In accordance with these and other objects which will become apparent hereinafter, the instant invention will now be described with particular reference to the accompanying drawings.

DETAILED DESCRIPTION OF THE INVENTION

Figure 1A:
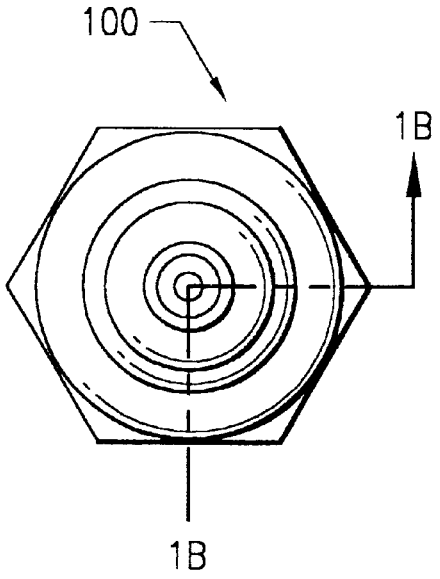
FIG. 1A (PRIOR ART)
FIG. 1A is a top plan view of a conventional spark plug of the background art.
Figure 1B:
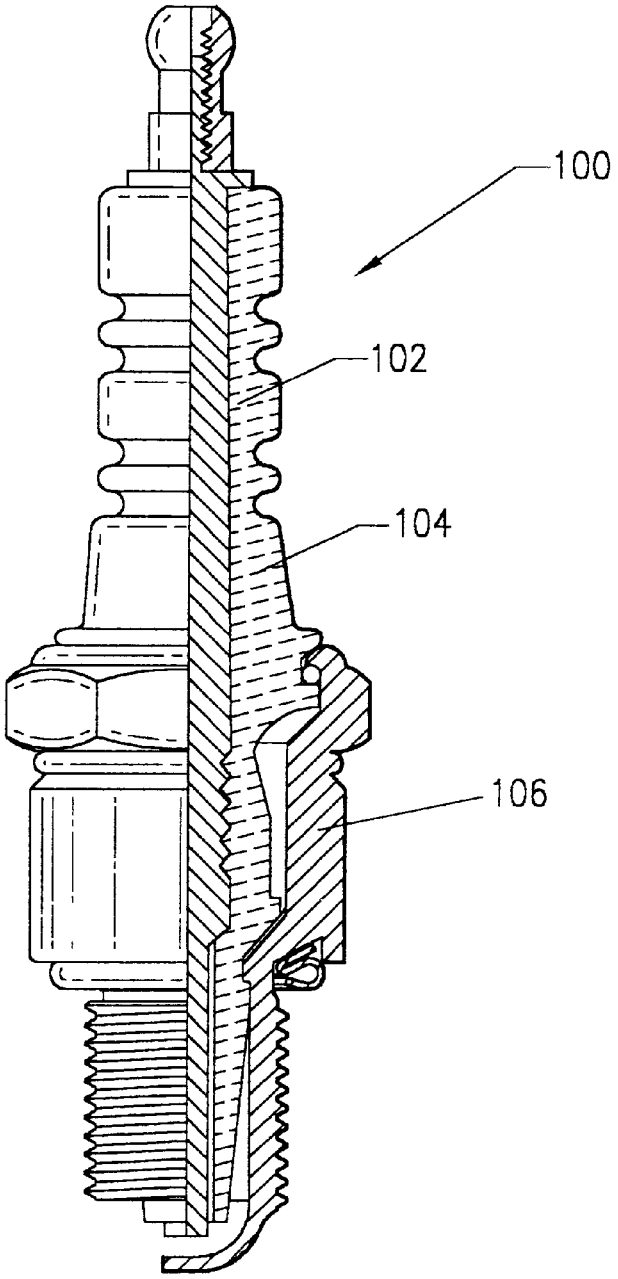
FIG. 1B (PRIOR ART)
FIG. 1B is a partially cut-away side sectional view along line 1B of FIG. 1A.

FIGS. 1A and 1B disclose one type of conventional spark plug, generally referenced as 100, which is known in the background art for use with an internal combustion engine. The conventional spark plug 100 includes an electrically conducting electrode 102, disposed within an insulating body 104, which insulating body is partially surrounded by a conducting outer body 106. Conducting outer body 106 includes a threaded outer surface for installation in a threaded spark plug port of an internal combustion engine. Once installed, the spark plug electrode is electrically connected to a spark delivery system (not shown) by spark plug wires.

Figure 2:
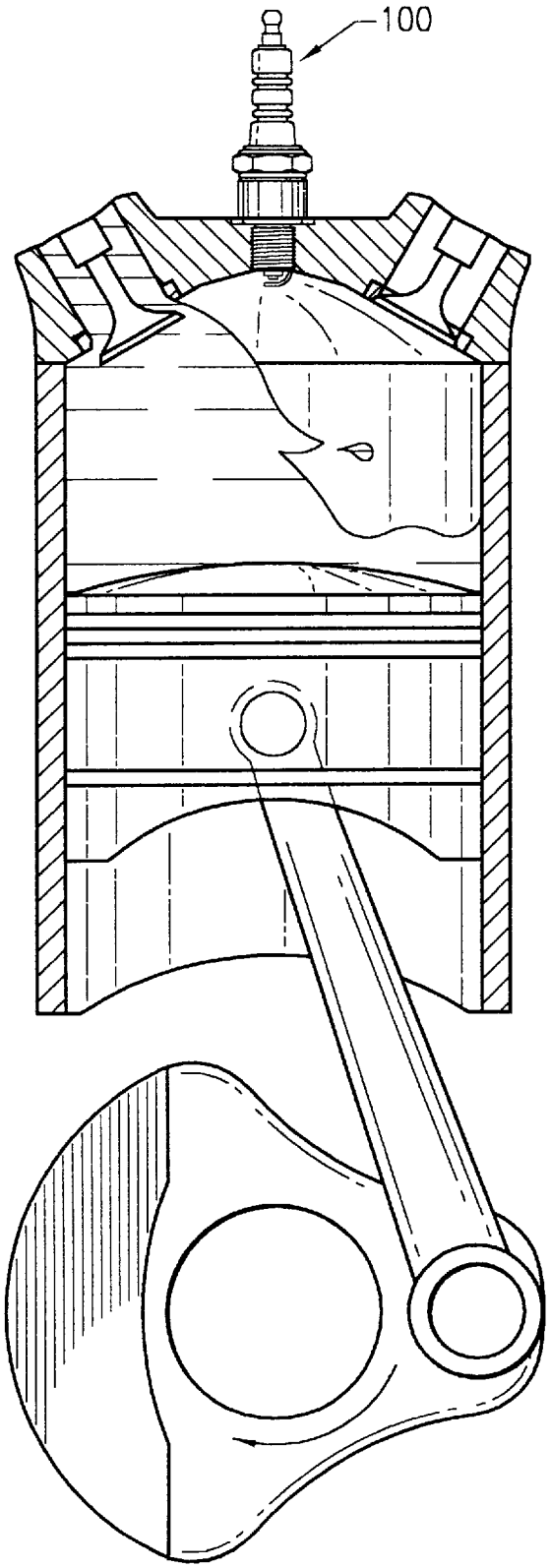
FIG. 2 (PRIOR ART)
FIG. 2 is a partial side sectional view of a spark plug, cylinder, piston and rod, and crankshaft of an internal combustion engine showing ingestion of water through an intake valve during the intake stroke of the engine.
Figure 3:
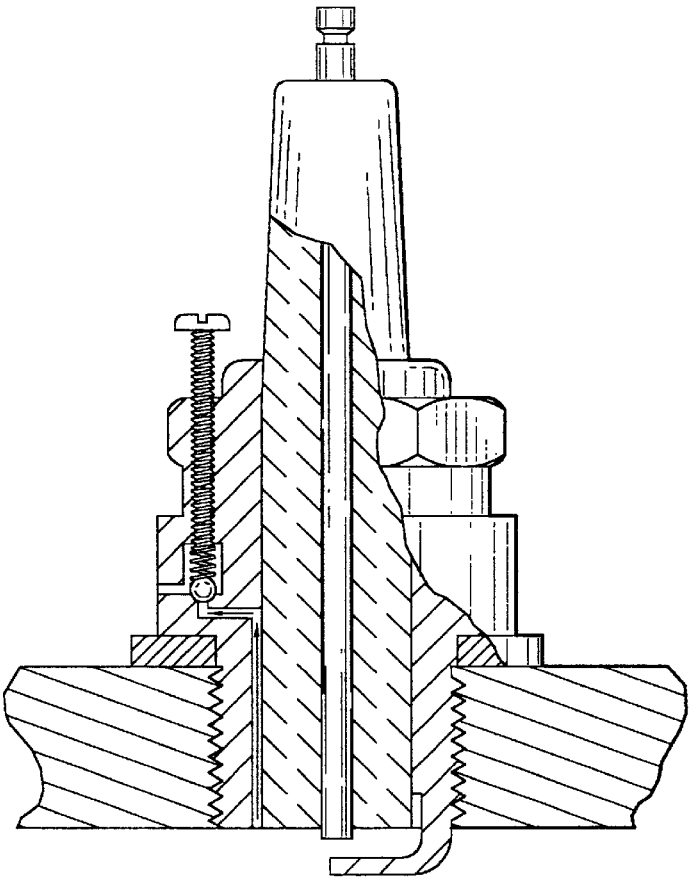
FIG. 3 (PRIOR ART)
FIG. 3 is a side sectional view of a pressure relieving spark plug of the background art.
Figure 4:
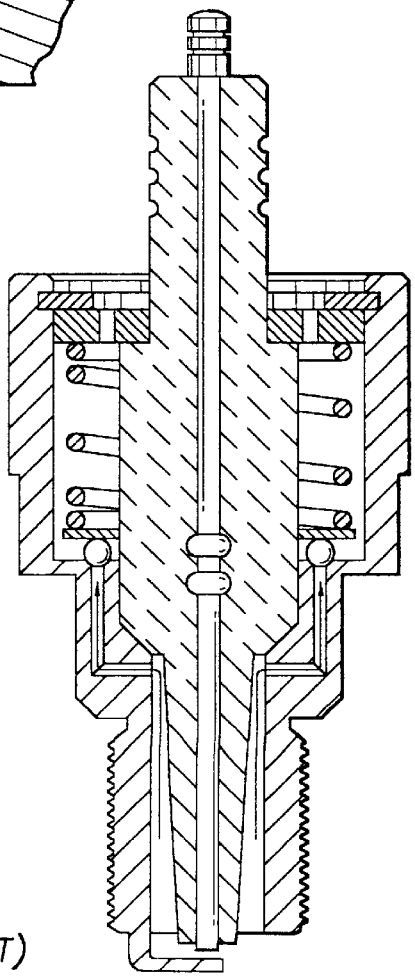
FIG. 4 (PRIOR ART)
FIG. 4 is a side sectional view of an alternate pressure relieving spark plug of the background art.

FIG. 2 illustrates a spark plug 100 installed in operative association with a combustion chamber of an internal combustion engine, wherein water is being ingested into the combustion chamber through the intake valve during the intake stroke. As discussed hereinabove, hydrolock occurs when water ingested into the combustion chamber (i.e. cylinder) effectively increases the compression ratio resulting in over pressurization of the combustion chamber components. FIGS. 3 and 4 show examples of pressure relieving spark plugs from the background art for venting the combustion chamber of an internal combustion engine.

FIGS. 5, 6, 7A, 7B, 7C and 8 show a resettable pressure relieving spark plug according to the present invention, generally referenced as 10, for use with an internal combustion engine. Spark plug 10 is responsive to excessive pressure within the combustion chamber for venting the chamber thereby preventing engine damage associated with operating conditions wherein excessive pressure is realized in the combustion chamber, such as the pressures resulting from hydrolock or detonation. Specifically, spark plug 10 functions as a conventional spark plug under normal operating conditions; however, upon the development of excessive combustion chamber pressures, the spark plug is designed to relieve pressure by one or more venting stages such that damage to the engine is averted.

Spark plug 10 includes a center electrode 12, an insulating body 14 disposed about the electrode, and an outer body consisting of upper and lower outer body portions, generally referenced as 16 and 18 respectively, in surrounding relation about insulating body 14. Center electrode 12, insulating body 14, and upper and lower outer body portions 16 and 18 are assembled into a unitary spark plug body suitable for use with a conventional internal combustion engine wherein the spark plug body effectively seals the combustion chamber (e.g. cylinder) under normal operating conditions. Upper outer body portion 16 defines a plurality of vent apertures, which, in the preferred embodiment comprise slots 16A. A first sealing member 20 provides a positive seal between insulating body 14 and upper outer body portion 16 under normal operating conditions. A second sealing member 22 provides a positive seal between upper and lower outer members 16 and 18, when upper and lower outer members are disposed in the substantially adjacent configuration depicted in FIG. 6. Center electrode 12, insulating body 14 and upper outer body portion 16 are fixedly connected into a unitary body. Lower outer body portion 18 is movably connected to upper outer body portion 16, as more fully described herein below.

Figure 6:
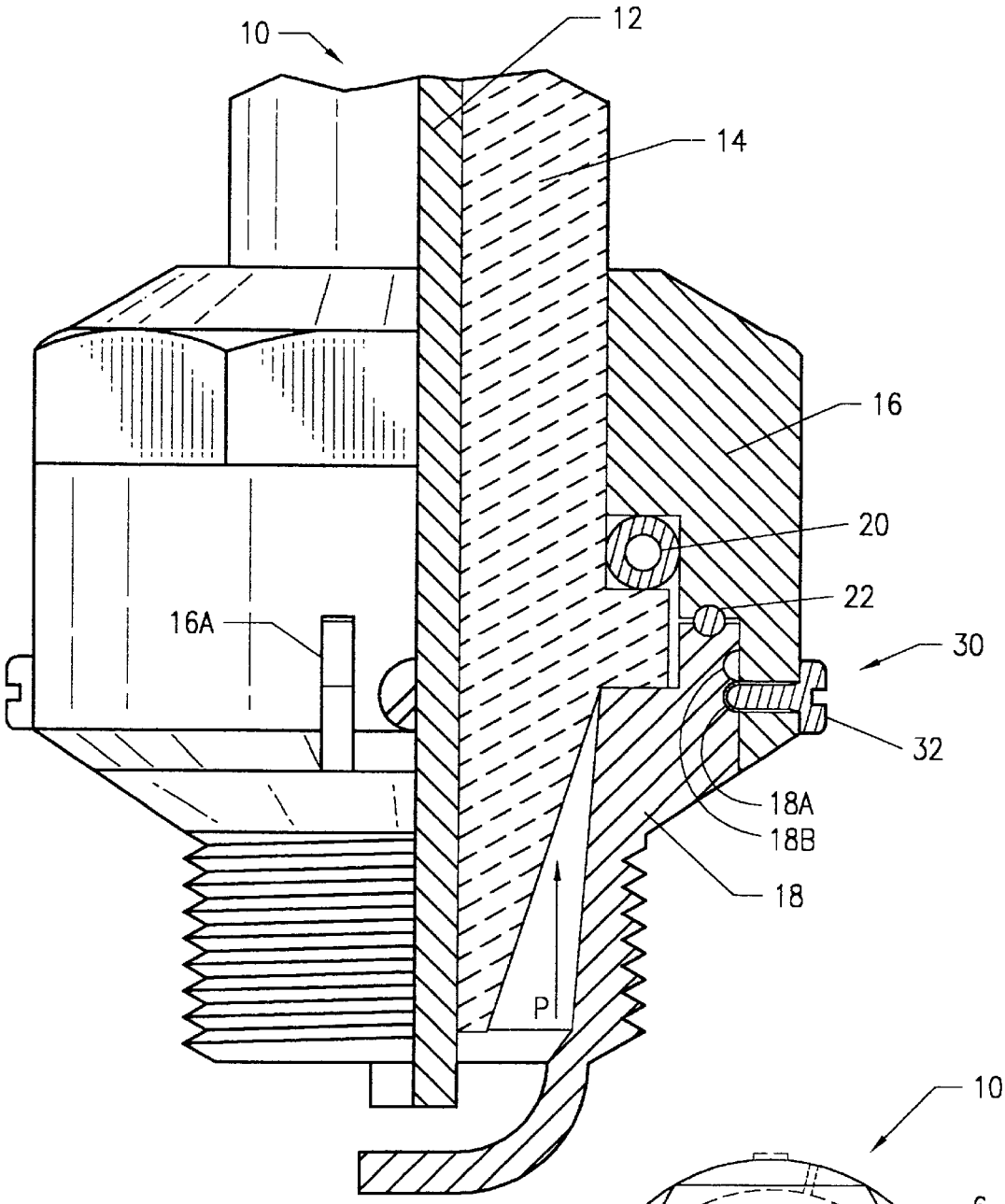
FIG. 6 is a partially cut-away side sectional view of a pressure relieving spark plug according to the present invention, along section line FIG. 6 in FIG. 5, in a non-venting configuration.
Figure 5:
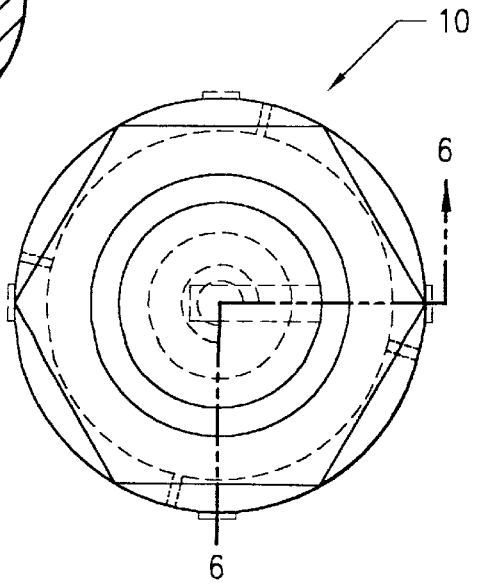
FIG. 5 is a top plan view of a spark plug according to the present invention in a non-venting configuration.
Figure 7B:
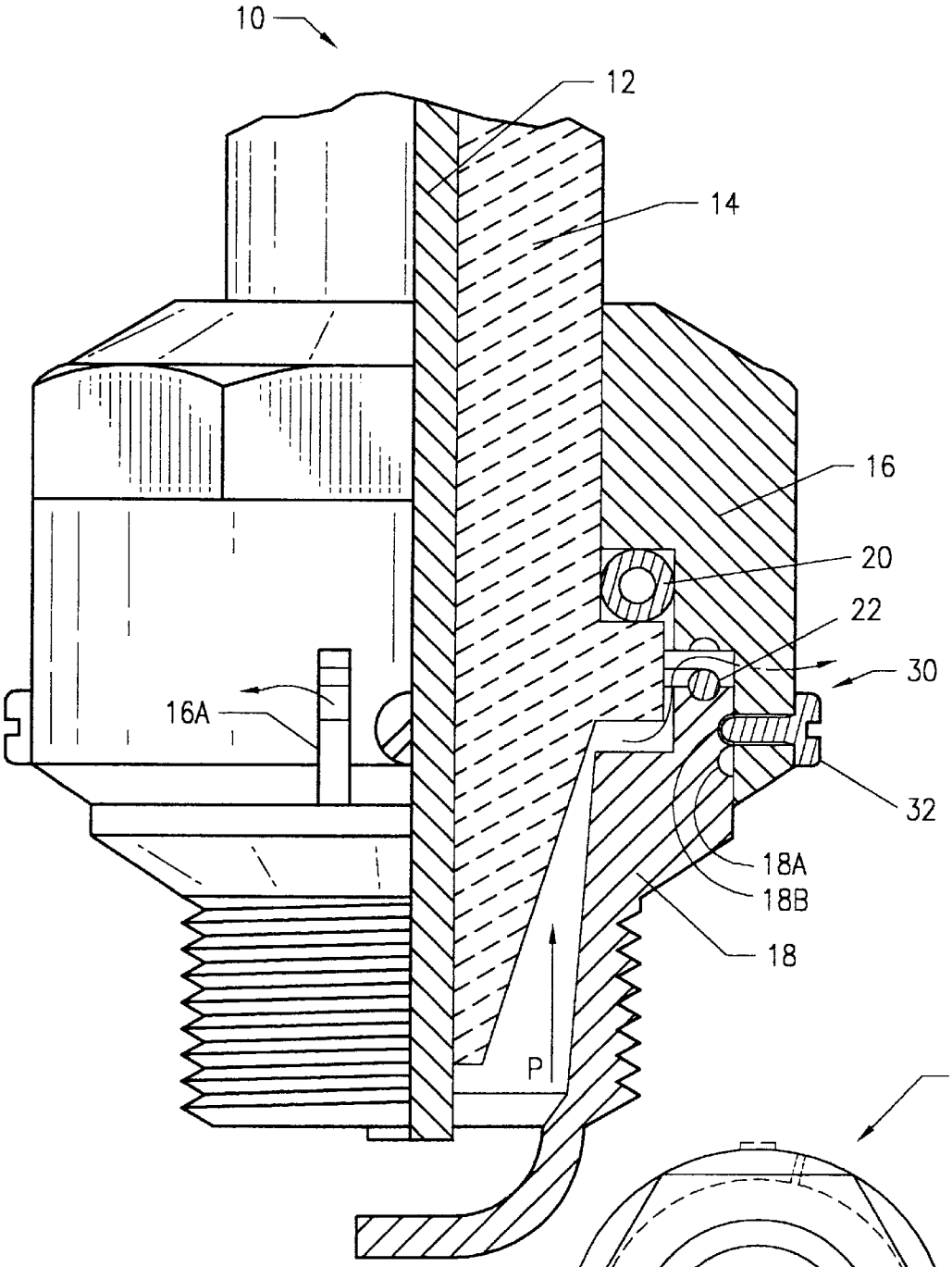
FIG. 7B is a partially sectioned view of the pressure relieving spark plug along line 7B—7B of FIG. 7A.
Figure 7A:
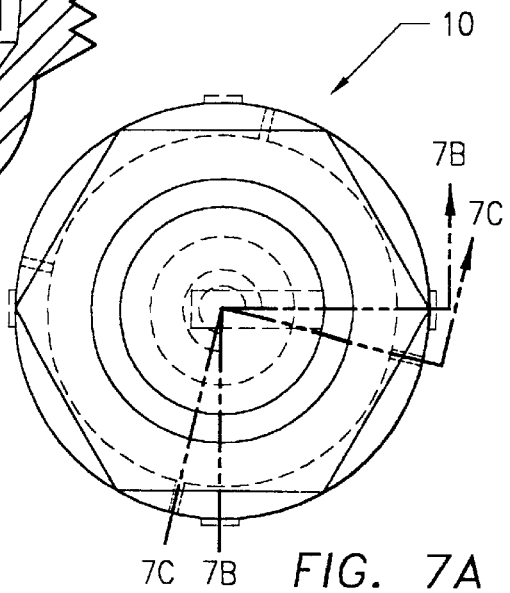
FIG. 7A is a top plan view of a spark plug according to the present invention in a venting configuration.
Figure 7C:
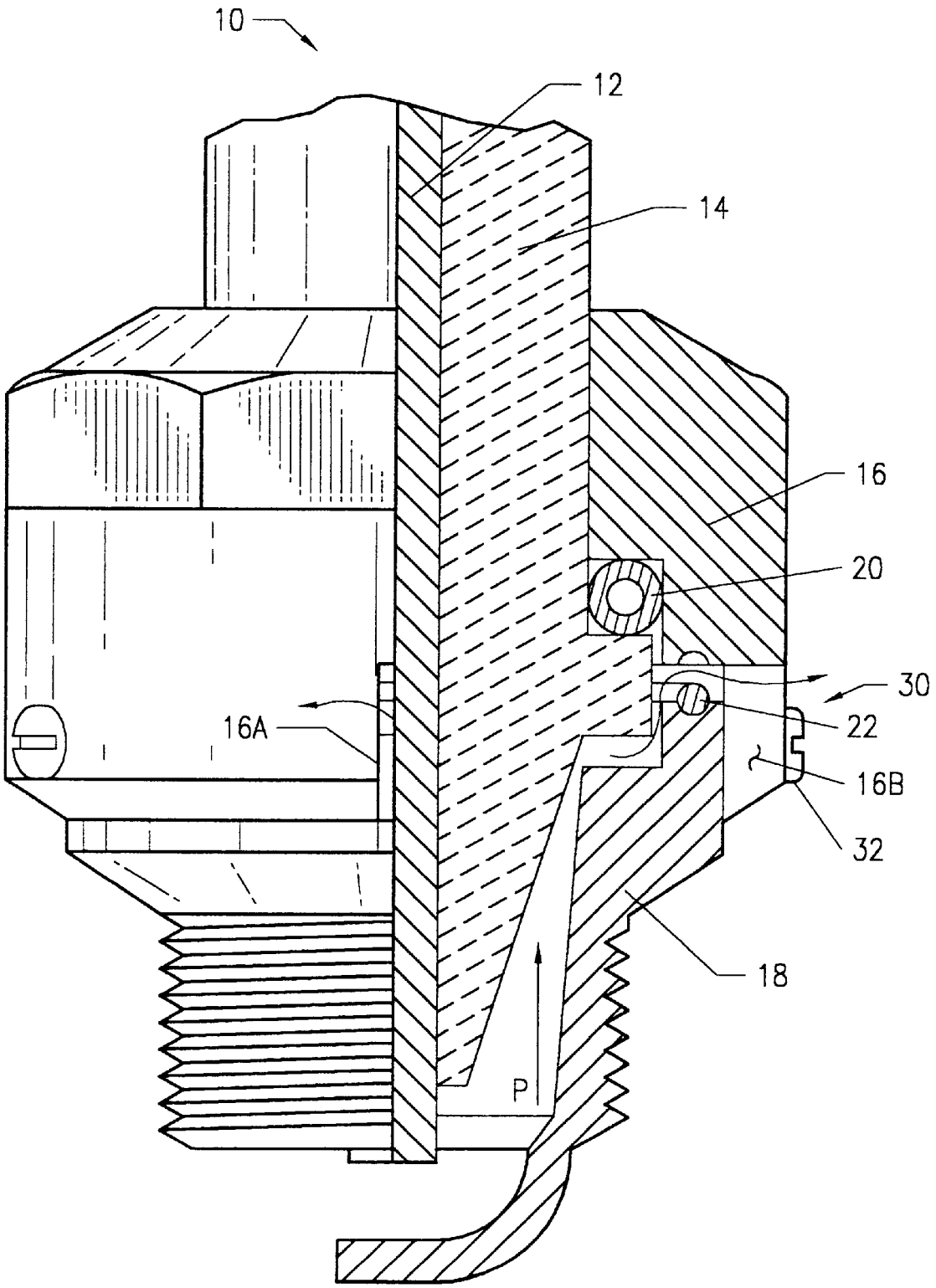
FIG. 7C is a partially sectioned view of the pressure relieving spark plug, along section line 7C—7C of FIG. 7A.
Figure 8:
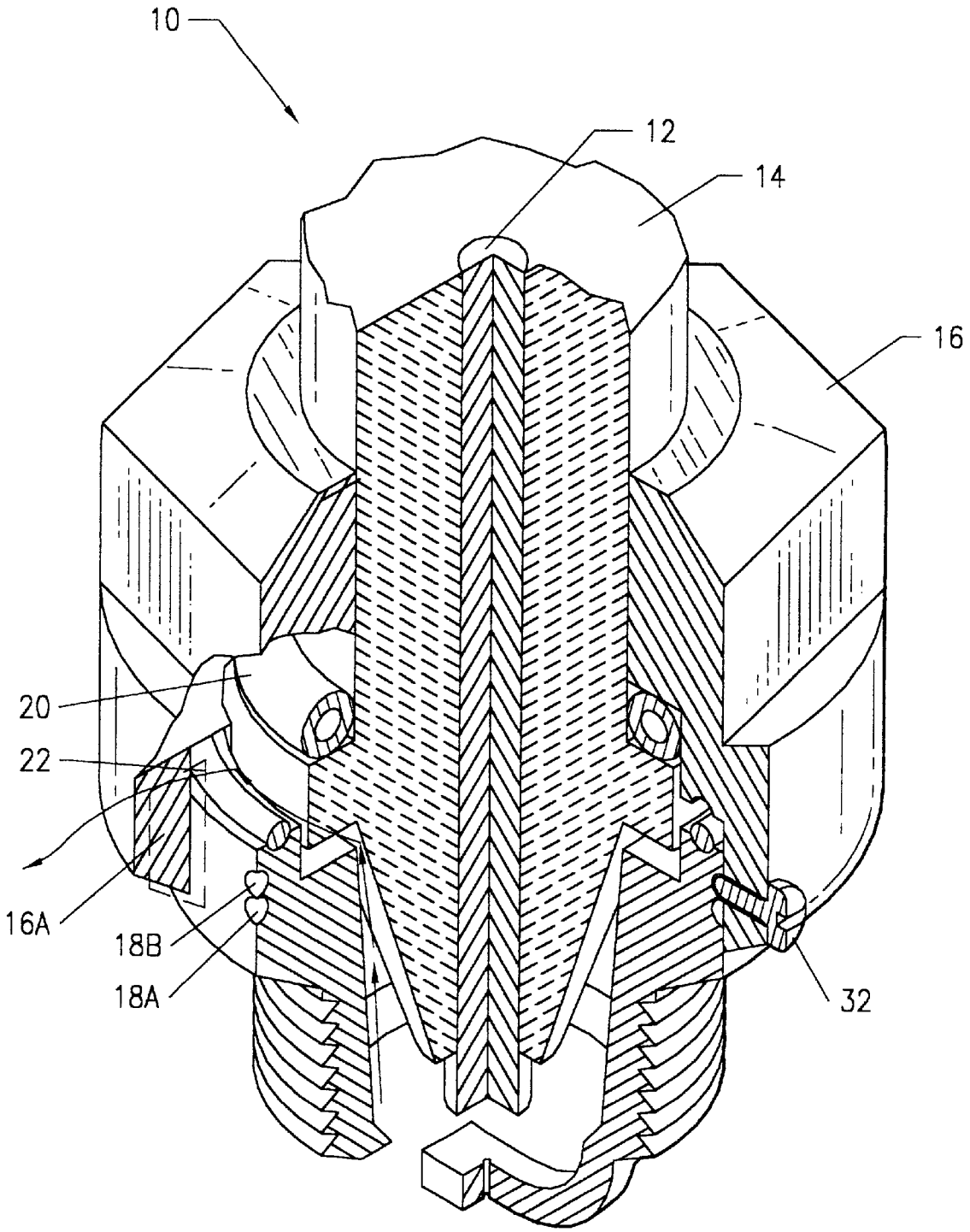
FIG. 8 is a partially sectioned top perspective view of the pressure relieving spark plug, shown in a venting configuration.
Figure 9:
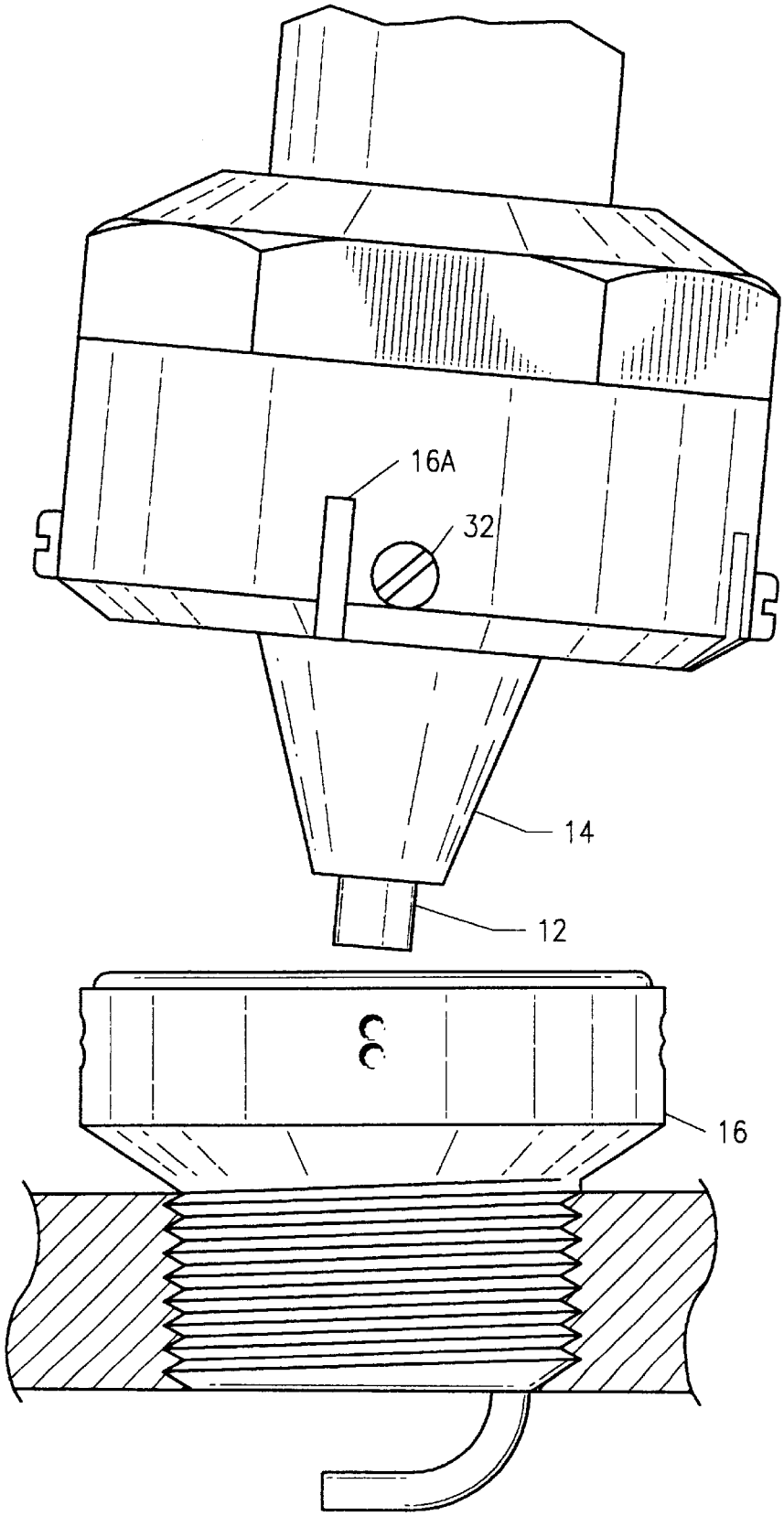
FIG. 9 is a partial view of a spark plug wherein the main body portion being ejected.

The spark plug components are resettably movable from a normal operating configuration, wherein the components function as a conventional spark plug as depicted in FIG. 6, to at least one venting configuration, wherein a vent passage is formed by the spark plug components to allow for the venting of contents form the combustion chamber through vent apertures 16A as depicted in FIGS. 7B, 7C and 8. In the preferred embodiment, upper and lower outer body portions are fastened relative to one another by a mechanical detent coupling structure, generally referenced as 30, such that a predetermined excessive cylinder pressure results in relative movement between the two body portions thereby opening a vent passage from the combustion chamber to the atmosphere thereby maintaining combustion chamber pressure within acceptable limits. A sufficient rise in combustion chamber pressure further results in ejection of the main body portion, thereby opening a substantial vent passage, as depicted in FIG. 9. Ejection of the main body portion is particularly desirable in response to hydrolock conditions since a substantial vent passage is required to expel water from the combustion chamber quickly enough such that engine damage is avoided.

In the preferred embodiment, the mechanical detent coupling 30 structure includes recesses 18A and 18B defined by lower outer body portion 18 for removably receiving an adjustable pawl, such as a threaded fastener 32. As best depicted in FIGS. 6, 7B and 7C, cylinder pressure acts on insulating body 14 creating an axial force on the upper outer body portion 16 which is fixedly connected thereto. The axial force results in a shear force on fastener 32. When the excessive cylinder pressure and resulting shear force reach a predetermined threshold, the upper outer body portion 16 undergoes radial elastic deformation thereby allowing the fastener 32 to be resettably dislodged from recess 18A and allowing an upward translation of the upper body portion 16 to a position wherein vent passages are opened such that combustion chamber contents may be vented through vent apertures 16A. The separation between components 16 and 18 is resettable in that simple mechanical adjustment of the detent coupling structure allows the spark plug to be reset to the normal operating configuration shown in FIG. 6. As further depicted in FIG. 9, a main body portion, center electrode 12, insulating body 14, and upper body portion 16 are completely separated from lower body portion 18 thereby creating a vent passage for allowing combustion chamber contents, such as water ingested in a hydrolock condition, to be expelled rapidly thereby preventing engine damage.

Radial elastic deformation of the upper body portion, and hence venting threshold pressure, may be selectively controlled by a variety of structural features. For example, the pawl may be selected based on tip shape (e.g. flat, radiused, pointed), and/or the contour of the recess may be selected from a variety of shapes (e.g. flat, sloped, radiused), and/or the depth that the pawl tip is received within the recess may be adjusted, each of which effect the force required to achieve sufficient radial elastic deformation and movement between components 16 and 18. Furthermore, the upper outer body portion may define vent slits, the size, shape, and/or number of which will effect the force required to achieve radial elastic deformation.

Figure 10:
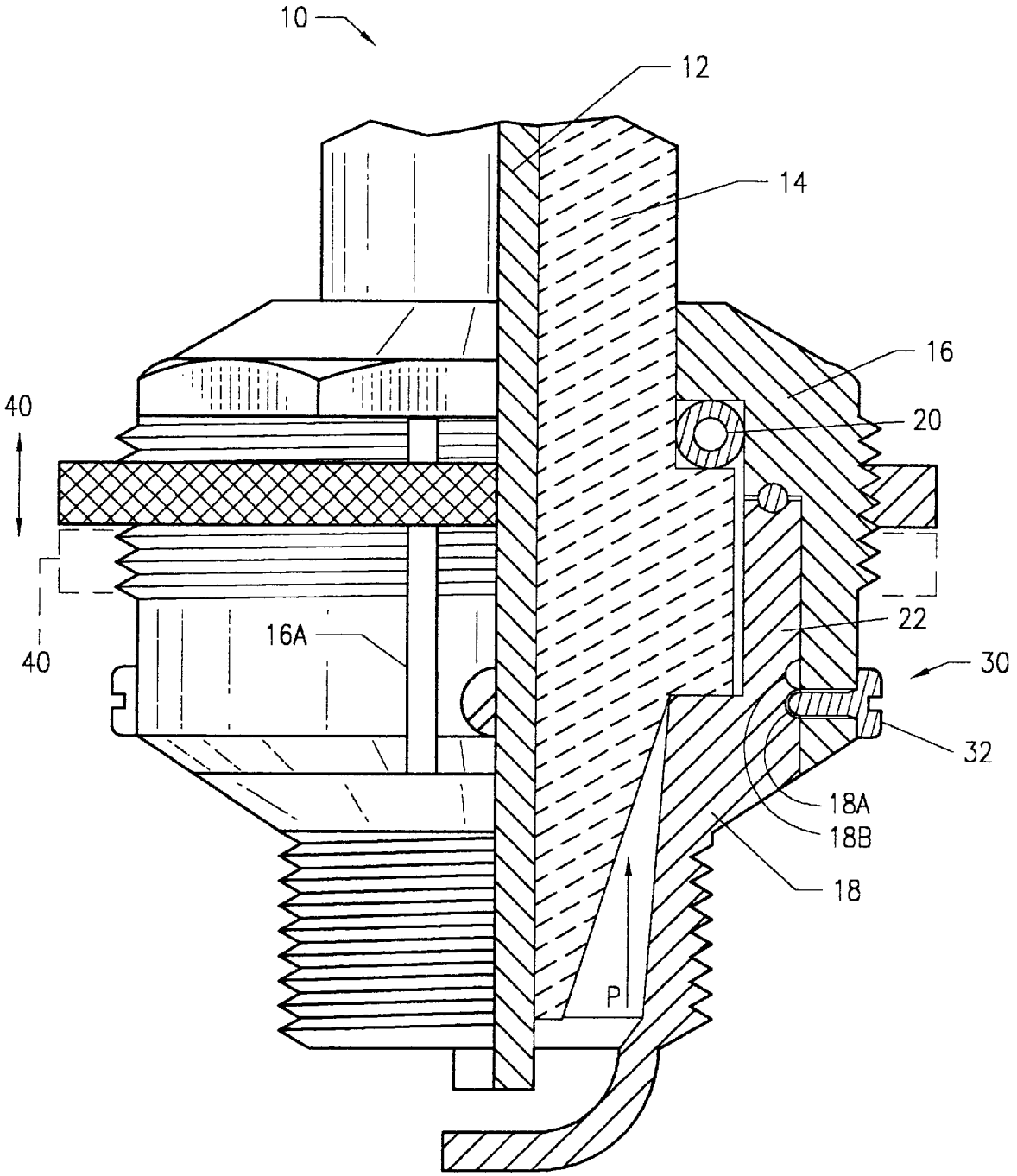
FIG. 10 is a partially sectioned view of an alternate embodiment pressure relieving spark plug including a threaded collar for selectively controlling radial elastic deformation.

FIG. 10 depicts an alternate embodiment wherein radial elastic deformation may be adjustably controlled by the position of a threaded collar 40 disposed on the upper outer member. Rotation of collar 40 results in axial translation of the collar with respect to upper outer body portion 16. Translation of collar 40 downward (i.e. toward lower outer body portion 18) functions to progressively restrict radial elastic deformation of outer body portion 16 thereby increasing the pressure required to dislodge fastener 32 from recess 18A. Accordingly, the axial position of collar 40 also provides means for adjusting the threshold pressure required to cause upper outer body portion 16 to shift to the venting configuration depicted in FIGS. 7B and 7C.

Figure 11:
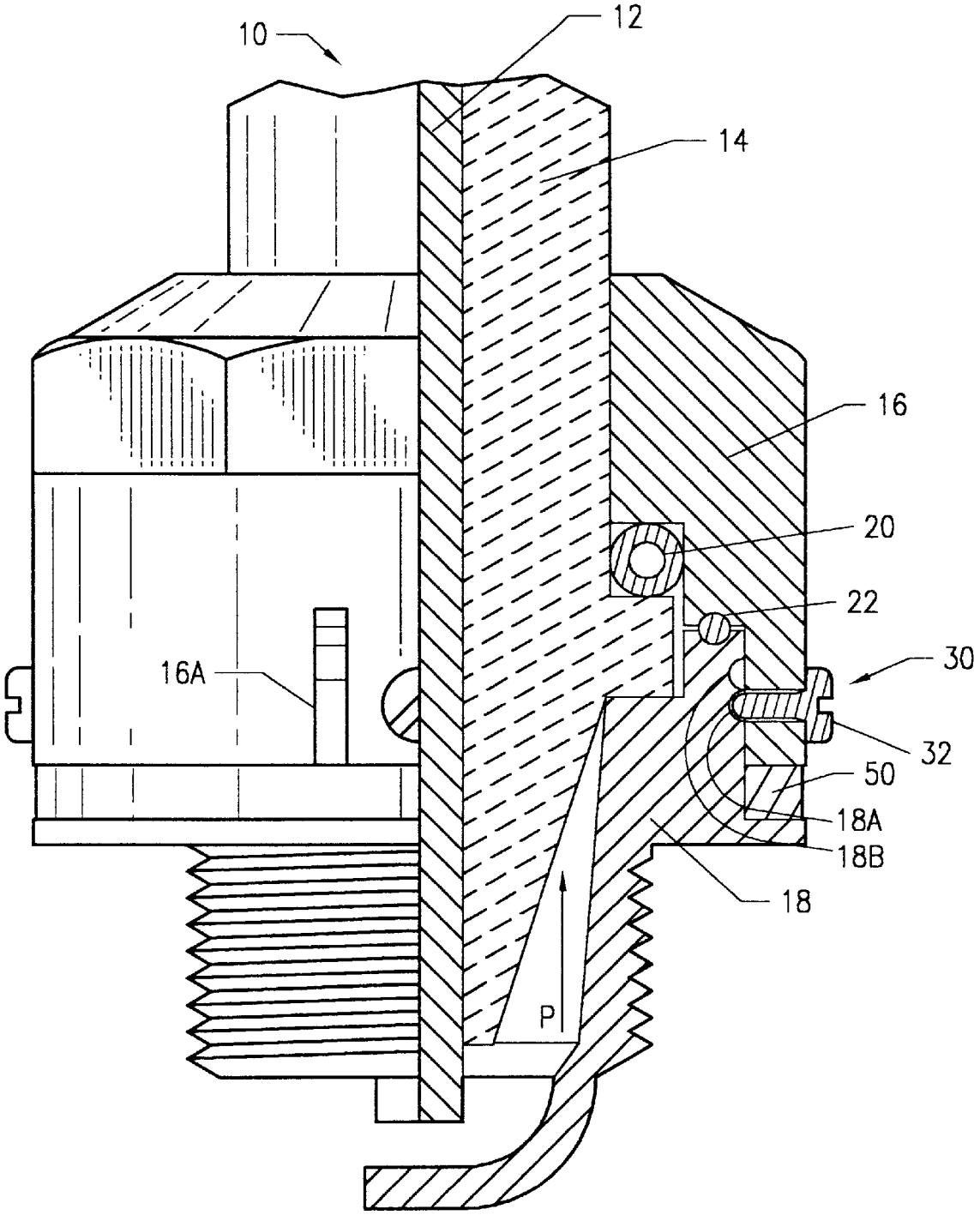
FIG. 11 is a partially sectioned view of an alternate embodiment pressure relieving spark plug including a thermally expanding insert.
Figure 12:
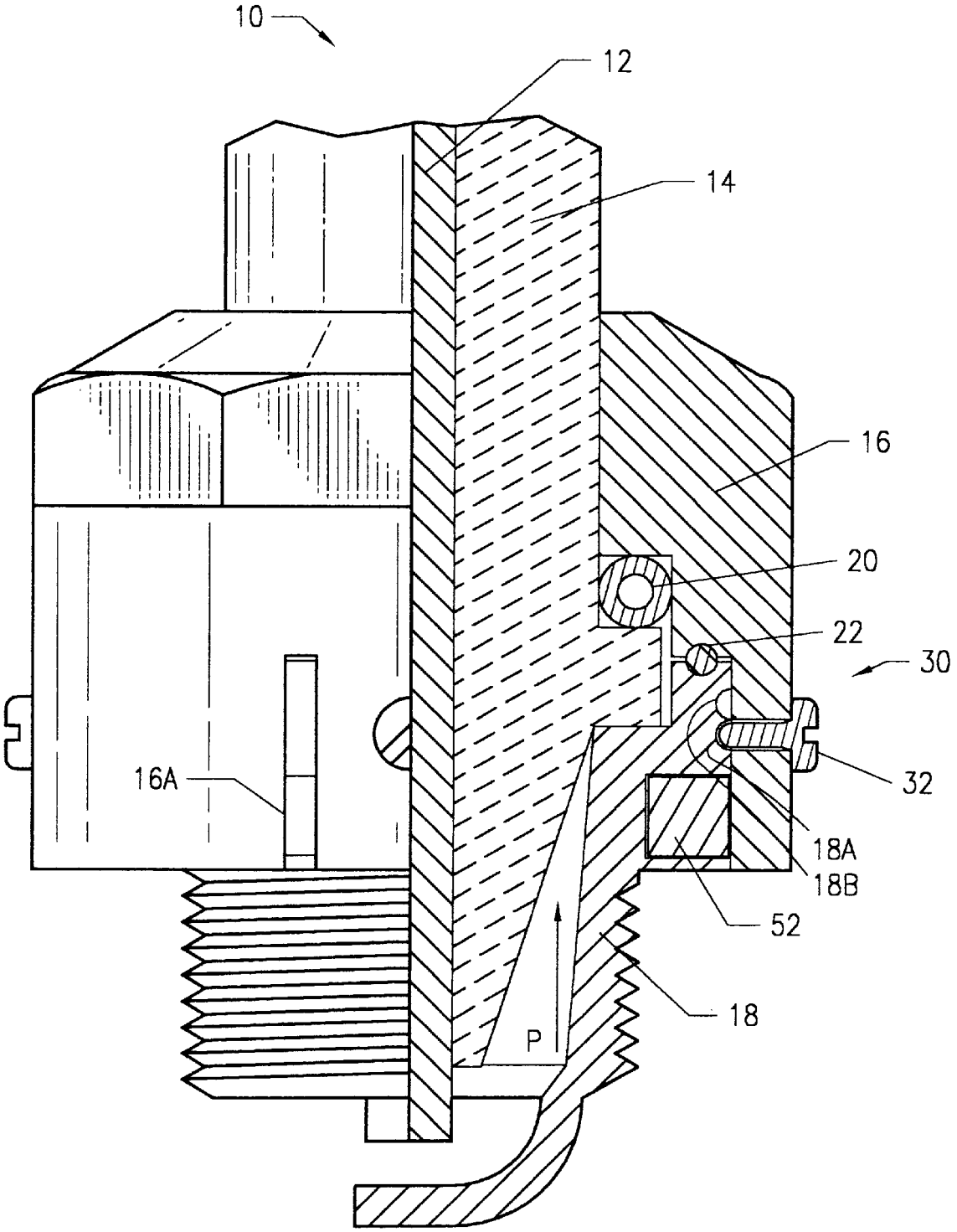
FIG. 12 is a partially sectioned view of an alternate embodiment pressure relieving spark plug including an alternate thermally expanding insert structure.

In an alternate embodiment shown in FIG. 11, the pressure relieving spark plug 10 is further responsive to excessive engine temperature as well as combustion chamber pressure. Specifically, since detonation is often accompanied by engine overheating, and since, the combination of overheating and detonation, left unabated, will likely result in engine damage, it is desirable to provide a vent the combustion chamber thereby diminishing the rate of heat generation. Accordingly, the present invention contemplates the use of expansion components, referenced as 50, having predetermined coefficients of thermal expansion such that excessive engine temperatures result in thermal expansion of selected spark plug components thereby causing the spark plug to shift to the venting configuration. FIG. 11 depicts an embodiment wherein a thermally expanding insert 50 is disposed between the outer body portions 16 and 18 such that thermal expansion of the insert results in an axial force that contribute to, and/or ultimately cause, separation of components 16 and 18 to the venting configuration. FIG. 12 depicts an alternate embodiment wherein a thermally expanding insert 52 is alternately disposed between outer body portions 16 and 18 such that thermal expansion of the insert results in both axial and radial forces that contribute to, and/or ultimately cause, separation of components 16 and 18 to the venting configuration. In yet another embodiment (not shown), the use of inserts 50 and 52 are eliminated, and the upper and lower outer body portions, 16 and 18 respectively, are fabricated from metals having dissimilar thermal expansion coefficients such that venting is facilitated by differing linear and/or volumetric expansion of the outer body portions 16 and 18. It should be apparent that the selection of materials, and particularly the selection of thermal expansion insert materials, is a significant aspect of these embodiments.

It is further contemplated that each of the embodiments disclosed herein may include one or more venting stages, such that multi-stage venting may be achieved. Accordingly, while the embodiments disclosed herein depict a single venting configuration, the present invention contemplates embodiments wherein multi-stage venting is accomplished.

The instant invention has been shown and described herein in what is considered to be the most practical and preferred embodiment. It is recognized, however, that departures may be made therefrom within the scope of the invention and that obvious modifications will occur to a person skilled in the art. As noted herein above, use of the term "spark plug" in the claims should be construed as reading on diesel engine glow plugs.

What is claimed is:

1. An improved spark plug having an elongated electrically conducting electrode, an electrically insulating body disposed in surrounding relation about the electrode and sealingly connected thereto, and an outer body disposed in surrounding relation about the insulating body, said spark plug for use with an internal combustion engine having at least one combustion chamber, wherein the improvement comprises:

said outer body including first and second outer body portions and means responsive to abnormal engine operating conditions for opening a vent passage through the spark plug, by relative movement between said first and second outer body portions from a normal operating position wherein said first and second outer body portions are sealingly connected, to a venting position wherein at least one vent passage, between the combustion chamber and the atmosphere, is opened.

2. A spark plug for use with an internal combustion engine according to claim 1, wherein said abnormal engine operating conditions include excessive pressure within the combustion chamber.

3. A spark plug for use with an internal combustion engine according to claim 1, wherein said abnormal engine operating conditions include excessive engine temperatures.

4. A spark plug for use with an internal combustion engine according to claim 1, wherein said means for opening a vent passage through the spark plug includes a mechanical detent coupling.

5. A spark plug for use with an internal combustion engine according to claim 4, wherein said mechanical detent coupling includes a pawl connected to said first outer body portion and at least one recess defined by said second outer body portion for removably receiving said pawl.

6. A spark plug for use with an internal combustion engine for relieving excessive pressure within a combustion chamber, said spark plug comprising:

an elongated electrically conducting electrode;

an elongated electrically insulating body disposed in surrounding relation about said electrode and sealingly connected thereto;

an outer body disposed in surrounding relation about said insulating body, said outer body including means for securing said outer body to a portion of the engine defining the combustion chamber such that a portion of said electrode and said insulating body communicate with said combustion chamber;

said outer body including first and second outer body portions, said first outer body portion sealingly connected to said insulating body, and said second outer body portion matingly connected to said first outer body portion and movable relative to said first outer body portion between a normal operating position wherein said first and second outer body portions are sealingly connected, and at least one venting position wherein at least one vent passage is opened between the combustion chamber and the atmosphere.

7. A spark plug for use with an internal combustion engine for relieving excessive pressure within a combustion chamber according to claim 6, wherein said first and second outer body portions are resettable to said normal operating position from said venting position.

8. A spark plug for use with an internal combustion engine for relieving excessive pressure within a combustion chamber according to claim 6, further including a mechanical detent coupling for maintaining said first and second outer body portions in said normal operating position under normal engine operating conditions, and for releasing said first and second outer body portions for movement to said at least one venting position upon an abnormal engine operating condition of predetermined severity.

9. A spark plug for use with an internal combustion engine for relieving excessive pressure within a combustion chamber according to claim 8, wherein said mechanical detent coupling includes said second outer body portion defining a recess, and a pawl connected to said first outer body portion, said pawl being removably received in said recess for maintaining said first and second outer body portions in said normal operating position under normal engine operating conditions, and for releasing said first and second outer body portions for movement to said at least one venting position upon an abnormal engine operating condition of predetermined severity.

10. A method for opening a vent passage through a spark plug in an internal combustion engine, said spark plug having an elongated electrically conducting electrode, an electrically insulating body disposed in surrounding relation about the electrode and sealingly connected thereto, and an outer body disposed in surrounding relation about the insulating body, said spark plug for use with an internal combustion engine having a combustion chamber, comprising the steps of:

providing an outer body including first and second outer body portions and means responsive to abnormal engine operating conditions for opening said vent passage through the spark plug, by allowing relative movement between said first and second outer body portions from a first, normal, operating position wherein said first and second outer body portions are sealingly connected, to a second, venting, position wherein at least one vent passage, between the combustion chamber and the atmosphere, is opened.

11. A method for opening a vent passage through a spark plug in an internal combustion engine according to claim 10, wherein said means responsive to abnormal engine operating conditions for opening said vent passage through the spark plug includes mechanical device means for preventing said relative movement between said first and second outer body portions during engine operating periods wherein combustion chamber pressure is below a predetermined threshold pressure.

12. A method for opening a vent passage through a spark plug according to claim 11, wherein said predetermined threshold pressure is a maximum design pressure for the combustion chamber.

13. A method for opening a vent passage through a spark plug according to claim 10, wherein said means responsive to abnormal engine operating conditions for opening said vent passage through the spark plug includes mechanical device means for preventing said relative movement between said first and second outer body portions during engine operating periods wherein engine temperature is below a predetermined threshold temperature.

14. A method for opening a vent passage through a spark plug according to claim 11, wherein said predetermined threshold temperature is 250° F.

15. A system for selectively venting the combustion chamber of an internal combustion engine in response to abnormal operating conditions, said system comprising:

a combustion chamber having a maximum design operating pressure;

a spark plug at least partially disposed within said combustion chamber, said spark plug including means responsive to combustion chamber pressure for selectively opening at least one vent passage through said spark plug by relative movement between first and second outer body portions from a normal operating position wherein said first and second outer body portions are sealingly connected, to a venting position wherein at least one vent passage, between the combustion chamber and the atmosphere, is opened.

16. A system for selectively venting the combustion chamber of an internal combustion engine according to claim 15, wherein said means responsive to combustion chamber pressure for selectively opening at least one vent passage through said spark plug by relative movement between said first and second outer body portions includes a mechanical detent coupling.

17. A system for selectively venting the combustion chamber of an internal combustion engine according to claim 16, wherein said mechanical detent coupling includes a pawl removably received within a recess.

18. A system for selectively venting the combustion chamber of an internal combustion engine according to claim 15, wherein said means responsive to combustion chamber pressure for selectively opening at least one vent passage through said spark plug by relative movement between said first and second outer body portions includes a thermally expanding insert disposed between said first and second outer body portions, whereby expansion of said insert causes relative movement between said first and second outer body portions.

19. A glow plug for use with an internal combustion diesel engine for relieving excessive pressure within a combustion chamber, said glow plug comprising:

an elongated glow plug element projecting into the combustion chamber of an internal combustion engine;

an outer body disposed in surrounding relation about said glow plug element, said outer body including means for securing said outer body to a portion of the engine defining the combustion chamber such that a portion of said glow plug element communicates with said combustion chamber;

said outer body including first and second outer body portions, said first outer body portion sealingly connected to said glow plug element, and said second outer body portion matingly connected to said first outer body portion and movable relative to said first outer body portion between a normal operating position wherein said first and second outer body portions are sealingly connected, and at least one venting position wherein at least one vent passage is opened between the combustion chamber and the atmosphere.

* * * * *